United States Patent [19]

Liao

[11] Patent Number: 4,653,359

[45] Date of Patent: Mar. 31, 1987

[54] STRUCTURAL IMPROVEMENT OF ELECTRIC SCREWDRIVER WITH RESPECT TO THE TORSION ADJUSTMENT THEREOF

[76] Inventor: Hsieh-Yuan Liao, 3F, No. 11, Alley 7, Lane 339, Fu-Der St., Nan-Kang Dist., Taipei, Taiwan

[21] Appl. No.: 786,869

[22] Filed: Oct. 11, 1985

[51] Int. Cl.[4] ..... B25B 23/157

[52] U.S. Cl. ..... 81/475; 81/57.14; 173/93

[58] Field of Search ..... 81/467, 473, 475, 57.11, 81/57.14, 57.12, 57.13; 173/93

[56] References Cited

U.S. PATENT DOCUMENTS

| | | | |
|---|---|---|---|
| 1,769,510 | 7/1930 | Herman | 81/475 |
| 2,552,840 | 5/1951 | Burke et al. | 81/57.11 X |
| 4,346,633 | 8/1982 | Rendl | 81/475 |
| 4,517,865 | 5/1985 | Huang | 81/475 |

*Primary Examiner*—James M. Meister

*Assistant Examiner*—John L. Knoble

*Attorney, Agent, or Firm*—Browdy and Neimark

[57] ABSTRACT

Structural improvement of electric screwdriver with respect to the torsion adjustment thereof, incorporating a torsion mechanism having outer threads in the anterior shell in coordination with a hollow-set torsion adjustment lid having correspondingly provided inner threads, so that manually imposed rotative feeding of the adjustment lid may force the supporting stem to exert depression on the depression spring through the adjustment disk, resulting in vertical engagement of both the upper and the lower ratchet, also in mortise joint of the torsion stem with the lower ratchet; that activation of a finely-touched switch starts the motor to acquire an increased torque by virtue of the main gear in relation to the vernier gear, eventually setting the torsion stem to rotation while locking the screw or else releasing the same, the torsion adjustment lid permissive of multiple-shifted helic adjustments with precision and convenience. The motor being smooth in running, thereby shortens time and labor in work.

3 Claims, 4 Drawing Figures

STRUCTURAL IMPROVEMENT OF ELECTRIC SCREWDRIVER WITH RESPECT TO THE TORSION ADJUSTMENT THEREOF

SUMMARY OF THE INVENTION

The present invention relates to a structural improvement of electric screwdriver, characterised in that the torsion mechanism is provided with a hollow-set torsion adjustment lid using screwing techniques so that transmission by rotation will set the adjustment disk subjected to the action of the depression spring, which makes possible of the provision of a multiple-stage fine adjustment means facilitating instantaneous electric conduction without manual operations, thus achieving convenience and ease of operation whilst in the meanwhile realising suitable torsion as required in the execution of the locking of screws and rendering unlikely slackening, loosening of the screw due to excessive or inadequate torsions that is often the case otherwise.

To people skilled in the art it is upset to realize that the torque output of screwdriver, either power-driven or pneumatically powered, scarcely permits direct or wilful adjustments whatever, and that means quite an inconvenience for industries where the business involves processing of screw assemblage, any attempt to modify the performance of a conventional screwdriver will necessarily have to involve reshuffling, re-assemblage of the mechanical parts thereof, such as spring components and associated parts, all this means gross waste of labor and time, yet will hardly prove truly effective; what is more, in being used to lock screws, the excessive overloading current coming up when the motor incorporated in the screwdriver is brought to a halting position, will easily invite activation of the transistors, the relay, thereby cutting off the power source, usually accompanied by damages to the armature, eventually the entire motor compartment, which arrangement is by no means an ideal mode of control from the viewpoints of electricity, still worse is that with such a traditional modified embodiment the magnitude of torque is directly propertional to the rotation speed, too small a torque having very negative effects on the working efficiency, all these shortcomings are well known to the professionals and they deserve revolutionary improvements which everybody should approve of.

Furthermore, transmission to conduction of existing power-driven screwdrivers is typically through palm depression of the trigger or else by means of a depression switch, and that the device will remain active only if the palm remains in the depressing state, which accounts very well for another point of inconvenience, what is more, the trigger or transmission point is largely mounted on the top surface of the device, which can become loosened off or get slackened down after certain period of use besides its difficulty in holding by hand.

In view of all the foregoing reasons, the inventor betook himself to provide structural improvements of traditional power-driven screwdrivers, and eventually worked out the present invention which makes possible maximum working efficiency in screwing work under practically the same working conditions as previous executions but with faster rate, more convenience and comforts to the user.

Accordingly, the primary object of the present invention is to provide structural improvements of traditional power-driven screwdrivers through the provision of a torsion adjustment cap which is controlled by a spring, complete with fine adjustment capabilities, a multiple of shifted settings and easy operations.

A further object of the present invention lies in the provision of the structural improvement of a power-driven screwdriver, which makes possible of the adjustment to the wanted torsion without affecting the life-span of service of the built-in motor, thereby promoting the working efficiency and performance capabilities.

A further object of the present invention lies in the structural improvement of a power-driven screwdriver which is provided with a spring means in the torsion mechanism so as to control the coupling of both the active and the passive ratchets, also with a shoe member bearing upon another shoe member so that a sliding effect is produced when the torsion rod goes beyond prescribed readings that are expressed in terms of pounds, this in order to refrain from affecting the motor rotation and fastening the screw to a more reliable condition than ever.

A further object of the present invention lies in the provision of the structural improvement of a power-driven screwdriver, which serves to eliminate such drawbacks as derailing of smaller screws owing to over-straight or else slackening owing to insufficiency of the locking effects when embodied as such.

A further object of the present invention lies in the provision of the structural improvement of a power-driven screwdriver, whereof activation and suspension of the motor are transmitted by the triggering of a rear adjustment disk and of a fine switch, in a manner that is safer and more versatile than ever.

Other features and advantages of the present invention will emerge from the following descriptions of embodiments given by way of illustration but not in any way limiting, with reference to the accompanying drawings in which:

DETAILED DESCRIPTION

Figure 1:
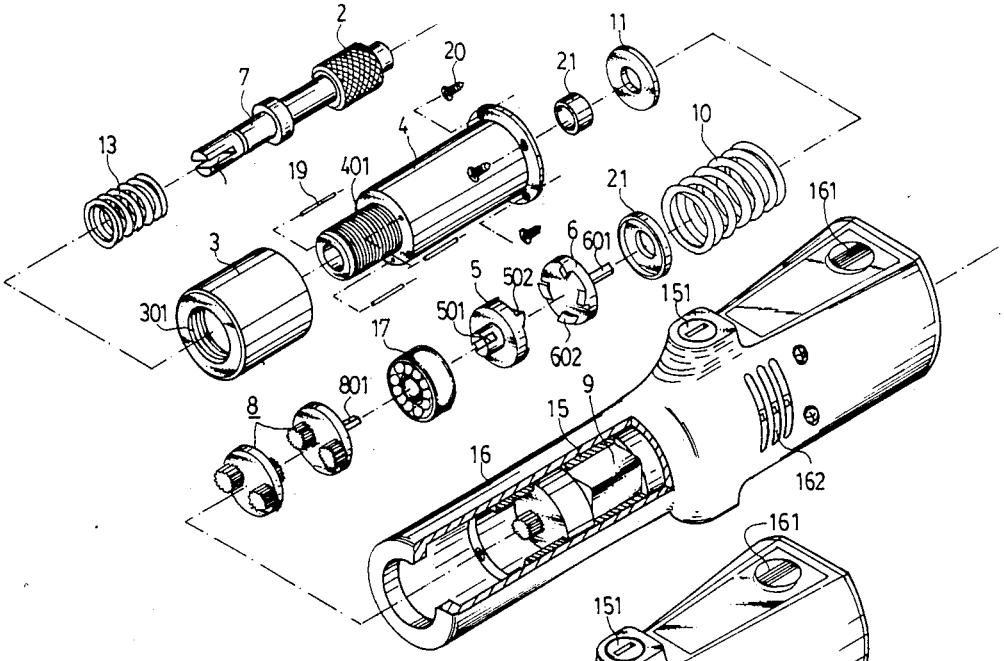
FIG. 1 is an exploded perspective of the invention.
Figure 2:
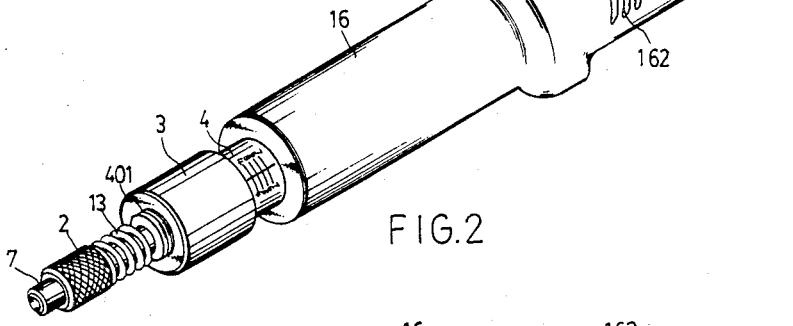
FIG. 2 is a perspective of the invention

Referring initially to FIG. 1, FIG. 2 it is seen that the invention screwdriver torsion adjusting device consists essentially of a clamp (2), a torsion adjustment cap (3), torsion mechanism (4), ratchet (5), a ratchet (6) complete with follower shaft 601, a torsion rod (7), a vernier gear set (8), motor (9), depression spring (10) and two adjustment disks 11, 12, a spring, driver head 14, motor shell 15 and outer shell 16; in the torsion mechanism 4 are mounted a roller bearing 17 and vernier switch 18 (not shown in the drawings), its fore shell being an outer threaded cylinder 401 provided in symmetry with an adjustment cap 3 having inner threaded flange 301, in front of the torsion mechanism 4 are mounted three supporting stems 19 each with one end bearing against the torsion adjustment cap 3, the other end extending into the torsion mechanism 4 to bring pressure to bear upon the adjustment disk 11, the depression spring 13 is introduced between both adjustment disks 11, 12; the torsion mechanism 4 is secured to the motor shell 15 and sheathed by an outer shell 16, The clamp 2 permits coupling with a driver head 14 which can be of any particular configurations, one end of the clamp 2 is a torsion rod 7 which extends into the torsion mechanism 4 and will rotate therein, the other end of the torsion rod 7 is provided with a mortise slot 701 to secure mortise joint with a follower shaft 601 extending from ratchet 6, on the boss 51 of the ratchet 6 is attached a rear adjustment disk 12, the disk 12 contact with a vernier switch 18 so that the vernier switch 18 will activate the motor the moment both ratchets 5, 6 are brought together, and cut off the motor power instead when both ratchets 5, 6 are separated. The main power originates from the motor 9, the motor RPM steps down through vernier gear set 8, thereupon increasing its torque output, by having a hub 801 mounted at the tip of the vernier gear 8 engaged with the mortise slot 501 in the ratchet 5 to cause ratchet 5, 6 couple together the torsion rod 7 for rotation.

Figure 3:
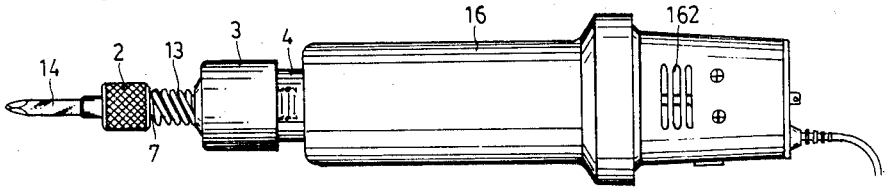
FIG. 3 is a side view of the invention.
Figure 4:
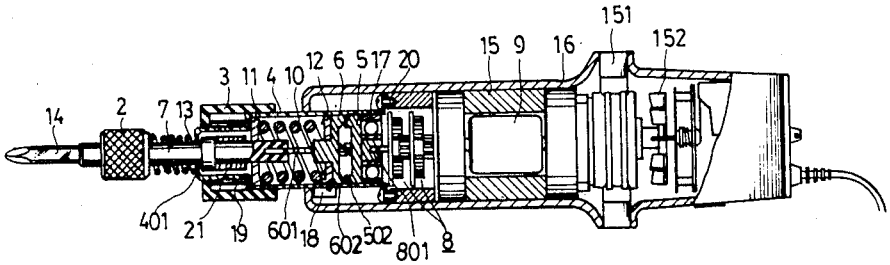
FIG. 4 is a cross-section view of the invention Brief description of the reference numbers:
(2) clamp, (3) torsion adjustment cap
(4) torsion mechanism, (5) (6) ratchet
(7) torsion rod, (8) vernier gear set
(9) motor, (10) depression spring
(11) (12) adjustment disk, (13) spring
(14) driver head, (15) motor shell
(16) outer shell, (17) roller bearing
(18) fine switch, (401) outer threaded cylinder
(301) inner threaded flange
(19) supporting stem, (701) mortise slot
(601) follower shaft, (801) hub
(501) mortise slot, (151) carbon brush cap
(161) power switch, (21) bushing
(152) fan, (162) window
(502) (602) shoe member, (51) boss axis

By continuing to refer to FIG. 3, FIG. 4 it is seen that on the outer rim of the torsion mechanism 4 is provided a graphic scale with readings of 1 through 7, this serving to indicate the reading of the torsion performed by the torsion mechanism 4 relative to the torsion adjustment cap 3. The deeper the torsion adjustment cap 3 is rotated inwardly, the readout figure will be greater, the depression spring 10 further restrained inwards, which indicates a tighter coupling between the ratchet 5 and ratchet 6, and consequently a closer engagement between the torsion rod 7 and the follower shaft of the ratchet 6, therefore a better transmission result, in the meantime the torque performed is greater; on the other hand, the torsion adjustment cap 3 will evince a smaller readout figure if work were produced to have it rotate backwards, which means lesser stress imposed on the depression spring 10 within, a shallower degree of coupling between the ratchet 5, and ratchet 6, likewise of the engagement of the follower shaft of ratchet 6 with the torsion rod 7, the overall effect will be smaller torsion output, therefore poorer transmission outputs. The torsion adjustment described in the foregoing comes in a number of settings in view of the differences in the strength to withstand the torque by different screws, in more specific terms, too stronger a torsion bearing upon a smaller screw being locked will bring it to a derailed condition, whereas too weak a torsion would likely fail to move the screw fixed in position, so that the lock of a screw can have best results if and only if the suitable torsion through adjustment is used, in the present case by virtue of the forward or backward feeding of the torsion adjustment cap 3 in a helically drawn path. The vernier adjustment feature as incorporated serves to effect highly accurate adjustments so as to prevent the situation from showing up where intended torsion is exceeded due to loose adjustments or else short met due to improper adjustments.

By referring to FIG. 4 it is seen that the outer shell 16 comes in the form of a dual section hollow body, the forward section including motor 9 and motor shell 15, the rear section housing a carbon brush cap 151 and fan 152 through which hot wind can be carried through window 162 to interact with atmosphere upon reaching the outer shell 16, that on the top of the outer shell is provided a power switch 161 which controls rotation of motor 5, in the forward or backward direction. On the contact face of ratchet 5 and ratchet 6 inside the torsion mechanism 4 are provided a correspondingly configured shoe members 502, 602, having inclined faces such that both shoe members will engage each other when both ratchets are engaged together. The driving moment is derived from the transmission of the motor, so that if a screw shall have been secured tight in position, shoe members 501, 601 of ratchets 5, 6 will slide away forthwith to abstain from yielding any transmission, ratchet 6 remaining motionless, whilst ratchet 5, although in rotation, will not cause the burning of the armature of motor 9 due to overloading.

To Set the invention device to working condition, the first step is to turn on the power switch 161 on the outer shell, (in a preferred embodiment, it is rotated in the clockwise direction). Next, the driver head 14 is depressed down to permit extension of the torsion rod 7 inwards, a bushing 21 being mounted upon the rod so that the adjustment disk 11 will bring pressure to bear upon the depression spring 10, to result in another adjustment disk 12 secured to the ratchet 6 functioning to bring both ratchets 5, 6 into engagement and the follower shaft 601 of the ratchet 6 engaged into the mortise slot 701 in the torsion rod 7, so that the vernier switch 18 will become activated when the rear adjustment disk 12 depresses downwards, whereupon motor 9 will drive the main gear to rotation and bring about an upgraded torque, i.e., reduced RPM, in joint effects with vernier gear set 8, and in case the torque in need is not produced in order, then efforts will have to be made by rotating the torsion adjustment cap 3 to step up the readings as indicated, thereby bringing more stress to bear upon the spring 10 till the desired reading indicative of the torque desired is attained. When a screw shall have been tightly locked in position, the torque will fail to move the screw any more, since shoe members 502, 602 of both ratchets 5, 6 will slide away from each other. Although the motor continues in motion, the torsion rod 7 stops moving, to permit resumption of the pressure spring 10 to its position, whereby the vernier switch 18 displaced elastically by the adjustment disk 12, so that the vernier switch 18 eventually cuts off the motor power.

Likewise, when it is intended to run the driver head 14 counterclockwise, it is only necessary to actuate the power switch 162 on the outer shell in the opposite direction to run the motor in the reverse direction, the only difference being that shoe members 502, 602 of both ratchets 5, 6 remain engaged with respect to respective vertical faces, this mode of operation typically being employed in the loosening, that is, in an attempt to remove, screws already fixed in position.

I claim:

1. In an electric screwdriver, a torsion adjustment mechanism, comprising:

an outer dual sectioned shell forming a grip for holding;

a motor mechanism installed in a forward section of the outer shell, incorporating;

(a) a motor shell, smaller than said outer shell and fixed to said forward section;

(b) a motor, mounted inside said motor shell and including a motor shaft;

(c) a main gear, fixed to the motor shaft and extending outside the motor shell;

a vernier gear unit, incorporated in the forward section of the casing and engaged with the main gear so as to help increase the torque, said gear unit having a transmission stem at one side;

a torsion rod, comprising an extensible transmission rod, having a clamp provided at a forward end to permit adaption with all kinds of screwdriver heads, the rear end having a mortise slot cut therein;

a torsion mechanism, incorporated in the forward section of the outer shell and seated in front of the motor, said torsion mechanism including:

(a) a torsion body, formed as a hollow tubing an outer threaded cylinder in front, the rear side thereof fitted to the motor casing, the torsion rod penetrated therethrough;

(b) a depression spring carried within the torsion mechanism and associated with the torsion rod, said spring enabling compression and expansion via its body;

(c) two adjustment disks, one provided in front of the depression spring, and the other to the rear side of the depression spring, the one adjustment disk being attached to the torsion rod so that under pressure it will compel the other adjustment disk to move through the depression disk;

(d) a bushing, attached to the torsion rod and in front of the one adjustment disk, driven by the torsion rod to compel the frontal adjustment disk to displace accordingly;

(e) three supporting struts mounted by the outer threaded cylinder in front of the torsion rod, tips of all three struts bearing against the one adjustment disk;

(f) a forward ratchet having a hub and a plurality of sloped shoe members, the hub being provided with a mortise slot for engagement with a complementary boss provided in vernier gear unit;

(g) a rearward ratchet, having a follower shaft and a plurality of slant shoe members, the shoe members being engageable with the counterpart provided on the forward ratchet, the follower shaft being mortise-jointed with the mortise slot on the rear of the torsion rod to achieve transmission;

(h) a bearing, of the ball-bearing type, provided over the hub perimeter of the upper ratchet to facilitate sliding; and (i) a vernier switch located by the torsion mechanism, controlled by the rearward adjustment disk, which in turn serves to selectively activate motor running;

a torsion adjustment cap, secured to the outer threaded cylinder of the torsion mechanism, the inner threaded cylinder including screwing studs to permit helical progression or recession;

whereby when the torsion adjustment cap is rotated to cause the supports to extend in the torsion mechanism, so that the forward adjustment disk reacts to compress the depression spring and both the forward and rearward ratchets are brought into engagement with each other via the other adjustment disk, the adjustment cap triggers the vernier switch to transmit the motor, so that the torsion rod is transmitted by virtue of the increased torque.

2. The torsion adjustment device according to claim 1, characterised in that the torsion rod is provided with an annular appendage to facilitate the moving of bushings.

3. The torsion adjustment device according to claim 1, characterised in that the outer shell is provided with scales indicative of the torque that prevails or is likely to result as the torsion adjustment cap is rotated in one, or the opposite, direction.

* * * * *